US009455079B2

(12) United States Patent
Shin et al.

(10) Patent No.: US 9,455,079 B2
(45) Date of Patent: Sep. 27, 2016

(54) MULTILAYERED POWER INDUCTOR AND METHOD FOR PREPARING THE SAME

(71) Applicant: SAMSUNG ELECTRO-MECHANICS CO., LTD., Suwon-si, Gyeonggi-do (KR)

(72) Inventors: Sung Sik Shin, Busan (KR); Myung Jin Han, Busan (KR); Ji Sook Choi, Busan (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 4 days.

(21) Appl. No.: 14/033,401

(22) Filed: Sep. 20, 2013

(65) Prior Publication Data

US 2014/0085037 A1 Mar. 27, 2014

(30) Foreign Application Priority Data

Sep. 21, 2012 (KR) ..... 10-2012-0105315

(51) Int. Cl.
*H01F 27/00* (2006.01)
*H01F 41/00* (2006.01)
(Continued)

(52) U.S. Cl.
CPC ..... *H01F 27/00* (2013.01); *H01F 17/0033* (2013.01); *H01F 41/00* (2013.01); *H01F 41/046* (2013.01); *H01F 27/292* (2013.01)

(58) Field of Classification Search
CPC ..... H01F 5/00; H01F 27/00–27/30
USPC ..... 336/65, 83, 200, 206–208, 220–223, 336/232–234
See application file for complete search history.

(56) References Cited

U.S. PATENT DOCUMENTS 6,404,318 B1 6/2002 Uchikoba et al.
7,889,044 B2 * 2/2011 Ueda et al. ..... 336/200
(Continued)

FOREIGN PATENT DOCUMENTS

CN 1283858 A 2/2001
CN 1700373 A 11/2005
(Continued)

OTHER PUBLICATIONS

Korean Notice of Allowance issued in Korean Application No. 10-2012-0105315 dated Mar. 3, 2014.
(Continued)

*Primary Examiner* — Tuyen Nguyen
(74) *Attorney, Agent, or Firm* — McDermott Will & Emery LLP

(57) ABSTRACT

Disclosed herein are a multilayered power inductor including a magnetic layer, an inner electrode layer, and an outer electrode layer, wherein a pore ratio at a section of the inner electrode layer is 7% or less and a method for preparing the same. According to the exemplary embodiments of the present invention, the number of pores in the inner electrode layer of the multilayered power inductor can be minimized and the residual carbon can be removed by the sintering delay of the inner electrode to increase the densification of the inner electrode layer after being sintered, thereby improving the RDC characteristics of the multilayered power inductor. Therefore, the multilayered power inductor including the inner electrode layer according to the exemplary embodiments of the present invention can implement the high capacity and the low RDC, thereby providing the small, thin, and multi-functional chip components.

9 Claims, 2 Drawing Sheets

(51) Int. Cl.

| | |
|---|---|
| ***H01F 17/00*** | (2006.01) |
| ***H01F 41/04*** | (2006.01) |
| *H01F 27/29* | (2006.01) |

(56) References Cited

U.S. PATENT DOCUMENTS

| | | | | |
|---|---|---|---|---|
| 8,330,568 | B2 * | 12/2012 | Konoue et al. | 336/233 |
| 8,390,983 | B2 * | 3/2013 | Jeong et al. | 361/311 |
| 8,410,886 | B2 * | 4/2013 | Odahara et al. | 336/200 |
| 2004/0084131 | A1 * | 5/2004 | Konoue | B32B 18/00 156/89.11 |
| 2009/0251268 | A1 | 10/2009 | Sato | |
| 2010/0225437 | A1 * | 9/2010 | Ueda et al. | 336/200 |
| 2011/0095856 | A1 | 4/2011 | Nakajima et al. | |
| 2012/0110807 | A1 * | 5/2012 | Kim | H01B 1/16 29/25.41 |
| 2013/0301185 | A1 * | 11/2013 | Lee | H01G 4/30 361/301.4 |

FOREIGN PATENT DOCUMENTS

| | | | |
|---|---|---|---|
| CN | 101568978 | A | 10/2009 |
| CN | 101821822 | A | 9/2010 |
| CN | 102017028 | A | 4/2011 |
| JP | 2005-174974 | A | 6/2005 |
| JP | 2006-128608 | A | 5/2006 |
| KR | 10-2000-0076983 | A | 12/2000 |
| KR | 10-2006-0062931 | A | 6/2006 |
| KR | 10-2009-0080128 | A | 7/2009 |
| KR | 10-2010-0127878 | A | 12/2010 |

OTHER PUBLICATIONS

Korean Office Action issued in Korean Patent Application No. 10-2012-0105315 mailed Oct. 15, 2013.

Notification of the First Office Action issued in corresponding Chinese Patent Application No. 201310370307.6, mailed on Aug. 3, 2015; with English translation.

* cited by examiner

- PRIOR ART -

MULTILAYERED POWER INDUCTOR AND METHOD FOR PREPARING THE SAME

CROSS REFERENCE(S) TO RELATED APPLICATIONS

This application claims the benefit under 35 U.S.C. Section 119 of Korean Patent Application Ser. No. 10-2012-0105315 entitled "Multilayered Power Inductor And Method For Preparing The Same" filed on Sep. 21, 2012, which is hereby incorporated by reference in its entirety into this application.

BACKGROUND OF THE INVENTION

1. Technical Field

The present invention relates to a multilayered power inductor and a method for preparing the same.

2. Description of the Related Art

As a demand for small, thin, and multi-functional electronic products is increased, a chip component also requires large-current components. In order to improve high-current characteristics keeping pace with thinness and multi-functional characteristics, there is a need to reform a material and use advantages between respective materials based on complexation.

In the case of the multilayered chip component, as a material of a magnetic layer body, ferrite having a quaternary structure such as Ni—Zn—Cu—Fe is used. However, a saturation magnetization value of the material is lower than that of a metallic material, such that it is difficult to implement specifications required for high current characteristics. Therefore, a mixture of the ferrite material and a metal alloy has been mainly used.

Meanwhile, in order to increase efficiency of a power inductor, RDC characteristics are considered as a critical factor. In order to increase the RDC characteristics per a unit volume, there is a need to increase densification of an electrode after the multilayered power inductor is fired.

As illustrated in FIG. 1, the multilayered power inductor according to the related art is configured to include a magnetic layer body 10 made of a ferrite material having a quaternary structure such as Ni—Zn—Cu—Fe, an inner electrode 20, and an outer electrode 30. The inner electrode 20 and the outer electrode 30 mainly use silver (Ag) and the outer electrode 30 may further include a plating layer.

In order to increase the efficiency of the power inductor, it is important to implement high capacity and low RDC. In order to increase the capacity, there is a problem in that a pattern of the inner electrode 20 is designed to be widened maximally and a thickness of a cover A covering the body 10 and the inner electrode 20 and a cutting margin B should be secured. Further, in order to reduce the RDC, there is a limitation of a design in increasing a sectional area of the inner electrode. Therefore, it is important to improve the RDC characteristics by densifying the structure of the inner electrode in the same sectional area.

In the case of the multilayered power inductor according to the related art, the pattern of the inner electrode 20 is implemented in the body 10 by printing silver paste (Ag paste) using a screen printing method and is multilayered/cut and is then fired by a co-firing method, thereby performing the densification of the electrode. In this case, the silver paste of the inner electrode 20 is more quickly densified due to a rapid sintering behavior as compared with ceramic materials of the ceramic body 10 and after the silver paste is fired, a number of pores occurs in the inner electrode 20 due to the effect of residual carbon (carbon that is not completely removed during a calcination process). The densification of the inner electrode 20 is reduced and the RDC characteristics are degraded, due to these pores.

Therefore, the existing method uses ceramic powders equal to or smaller than a size of metal powders used in the inner electrode layer as a sintering inhibitor to limit a contact between the metal powders, thereby maximally delaying a shrinkage starting temperature of the inner electrode, but cannot expect a sufficient effect until now.

Further, at the time of co-firing the magnetic layer body 10 and the inner electrode 20, a delamination defect, such as a crack of the magnetic layer after the power inductor is fired, may frequently occur due to stress caused by the mismatching of the sintering behavior between the material of the inner electrode and the ceramic material of the magnetic layer body.

RELATED ART DOCUMENT

Patent Document (Patent Document 1) Japanese Patent Laid-Open Publication No. 2005-174974

SUMMARY OF THE INVENTION

An object of the present invention is to provide a multilayered power inductor with improved RDC characteristics by minimizing the number of pores formed in the inner electrode after being fired and improving densification of the inner electrode using a specific sintering inhibitor in an inner electrode layer.

Another object of the present invention is to provide a multilayered power inductor capable of improving a delamination defect of a ceramic layer due to mismatching of a sintering behavior even at the time of co-firing an inner electrode and a ceramic body.

In addition, still another object of the present invention is to provide a method for preparing a multilayered power inductor.

According to an exemplary embodiment of the present invention, there is provided a multilayered power inductor, including: a magnetic layer, an inner electrode layer, and an outer electrode layer, wherein a pore ratio at a section of the inner electrode layer is 7% or less.

The inner electrode layer may include a sintering inhibitor of 0.01 to 2 parts by weight for every 100 parts by weight of a metal powder.

The metal powder may be silver (Ag).

The sintering inhibitor may be one or more selected from a group consisting of $ZrO_2$, $MnO_2$, $TiO_2$, and $Fe_2O_3$.

The sintering inhibitor may have an average particle size of 1 μm or less and a melting point of 1200° C. or more.

A thickness of the inner electrode layer may be 20 to 80 μm.

According to another exemplary embodiment of the present invention, there is provided a multilayered power inductor, including: a magnetic layer; an inner electrode layer including a metal powder and a sintering inhibitor; and an outer electrode layer, wherein a section of the inner electrode layer has a pore ratio of 7% or less and the sintering inhibitor of the inner electrode layer has an average particle size of 1 μm or less and a melting point of 1200° C. or more.

The metal powder of the inner electrode layer may be silver (Ag).

The inner electrode layer may include the sinter inhibitor of 0.01 to 1 parts by weight for every 100 parts by weight of the metal powder.

The sintering inhibitor may be one or more selected from a group consisting of $ZrO_2$, $MnO_2$, $TiO_2$, and $Fe_2O_3$.

A thickness of the inner electrode layer may be 20 to 80 μm.

According to still another exemplary embodiment of the present invention, there is provided a method for preparing a multilayered power inductor, including: forming a green sheet that is a ceramic body; forming an inner electrode layer on the green sheet; obtaining an unfired laminate by multilayering and cutting the green sheet on which the inner electrode layer is formed; firing the unfired laminate; and forming an outer electrode layer, wherein the inner electrode layer includes a metal powder and a sintering inhibitor and the sintering inhibitor has an average particle size of 1 μm or less and a melting point of 1200° C. or more.

At the time of a firing process of the multilayered sheet, the inner electrode and the ceramic body may be co-fired.

A thickness of the inner electrode layer may be 20 to 80 μm.

After the firing process, a pore ratio at a section of the inner electrode layer may be 7% or less.

DESCRIPTION OF THE PREFERRED EMBODIMENTS

Figure 1:
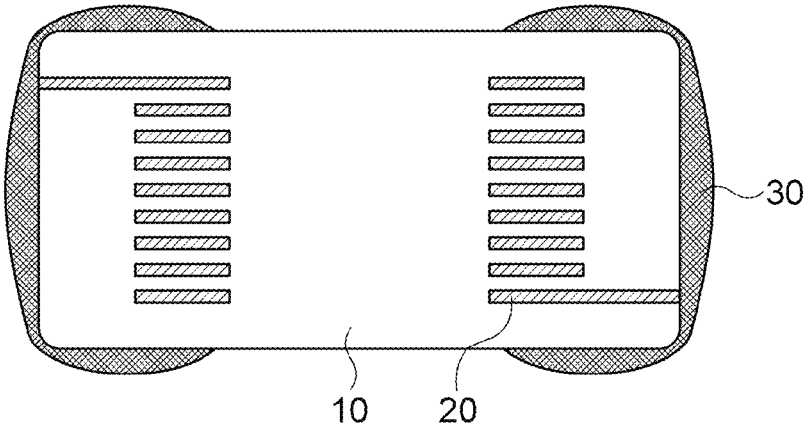
FIG. 1 is a schematic diagram of an inside of a multilayered power inductor according to the related art.

Hereinafter, exemplary embodiments of the present invention will be described in detail.

Terms used in the present specification are for explaining the embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

An exemplary embodiment of the present invention relates to a multilayered power inductor with excellent capacity characteristics and improved RDC characteristics and a method for preparing the same.

A multilayered power inductor according to an exemplary embodiment of the present invention includes a magnetic layer, an inner electrode layer, and an outer electrode layer, and a section of the inner electrode layer has a pore ratio of 7% or less, preferably, 1 to 5%.

The pore ratio (%) of the section of the inner electrode layer is obtained by calculating a ratio of an area occupied by pores in a total area of the inner electrode layer as shown by the following Equation 1 and the present invention may minimize a pore ratio of the inner electrode layer to increase the densification of the inner electrode layer.

$$\text{Pore ratio}(\%)=(\text{area occupied by pore/total area of inner electrode layer})\times 100 \quad \text{(Equation 1)}$$

The inner electrode layer according to the exemplary embodiment of the present invention includes a metal powder and a ceramic sintering inhibitor and the sintering inhibitor may include 0.01 to 1 parts by weight for every 100 parts by weight of the metal powder. When the content of the sintering inhibitor is out of the range, the sintering delay effect of the inner electrode is not sufficient, which is not preferable.

As the metal powder included in the inner electrode layer, silver (Ag) may be preferably used but copper (Cu) may also be used.

Further, the sintering inhibitor included in the inner electrode layer may be one or more selected from a group consisting of $ZrO_2$, $MnO_2$, $TiO_2$, and $Fe_2O_3$. Among others, $ZrO_2$ may be most preferably used. The sintering inhibitor of the inner electrode layer may preferably have an average particle size of 1 μm or less and a melting point of 1200° C. or more. When the average particle size of the sintering inhibitor included in the inner electrode layer exceeds 1 μm, the sintering delay effect of the inner electrode may be degraded, which is not preferable.

In the case of the inner electrode layer according to the exemplary embodiment of the present invention, the inner electrode layer has at least two layers of laminar structure due to the growth of grains of a metal powder from an interface with the magnetic layer when being fired. According to the exemplary embodiment of the present invention, when a fine ceramic sintering inhibitor is included in the inner electrode layer, the ceramic sintering inhibitor hinders the grain growth of the metal powder. In addition, the smaller the particle size of the ceramic sintering inhibitor, the more the content of the ceramic sintering inhibitor included in the inner electrode layer increases, such that this phenomenon is remarkable.

Therefore, the sintering behavior of the inner electrode is delayed by hindering the densification of the metal powder, that is, silver (Ag) during the co-firing process to improve the mismatching of the sintering behavior between the inner electrode layer and the magnetic layer, thereby improving a delamination defect due to stress.

Further, as the surface is not completely densified according to the delay of the sintering behavior, the residual carbon may not be sufficiently removed, and thus the number of pores in the inner electrode layer is reduced, thereby minimizing the pore ratio in the inner electrode layer after being fired and increasing the densification of the electrode.

The reason why the thickness of the inner electrode layer according to the exemplary embodiment of the present invention has a range of 20 to 80 μm is that pores occurs in a thick film at which the thickness of the electrode is thick during the sintering process to degrade the densification of the electrode.

The magnetic layer of the multilayered power inductor according to the exemplary embodiment of the present invention is preferably made of Ni—Zn—Cu ferrite and is prepared from a ferrite composition prepared by adding an organic binder and a solvent thereto.

In addition, the outer electrode layer of the multilayered power inductor according to the exemplary embodiment of the present invention is preferably made of the same material as the metal powder included in the inner electrode layer and the outer electrode layer may also be added with a plating layer if necessary.

Further, a multilayered power inductor according to another exemplary embodiment of the present invention is a multilayered power inductor that includes a magnetic layer, an inner electrode layer including a metal powder and a sintering inhibitor, and an outer electrode layer and the section of the inner electrode layer has a pore ratio of 7% or less and the sintering inhibitor of the inner electrode layer has an average particle size of 1 μm or less and a melting point of 1200° C. or more.

As the metal powder included in the inner electrode layer, silver (Ag) may preferably be used but copper (Cu) may also be used.

The inner electrode layer may preferably include the sintering inhibitor of 0.01 to 1 parts by weight for every 100 parts by weight of the metal powder.

Further, the sintering inhibitor may be one or more selected from a group consisting of $ZrO_2$, $MnO_2$, $TiO_2$, and $Fe_2O_3$. Among others, $ZrO_2$ may be most preferably used. The sintering inhibitor of the inner electrode layer may preferably have an average particle size of 1 μm or less and a melting point of 1200° C. or more. When the particle size exceeds 1 μm, the sintering delay effect of the inner electrode may be degraded.

The thickness of the inner electrode layer has a range of 20 to 80 μm.

The magnetic layer of the multilayered power inductor is preferably made of Ni—Zn—Cu ferrite and is prepared from a ferrite composition prepared by adding an organic binder and a solvent thereto.

In addition, the outer electrode layer of the multilayered power inductor according to the exemplary embodiment of the present invention is preferably made of the same material as the metal powder included in the inner electrode layer and the outer electrode layer may also be added with a plating layer if necessary.

Further, a method for preparing a multilayered power inductor according to another exemplary embodiment of the present invention includes forming a green sheet that becomes a magnetic layer, forming the inner electrode layer on the green sheet, multilayering and cutting the green sheet on which the inner electrode layer is formed to obtain an unfired laminate, firing the unfired laminate, and forming the outer electrode layer, wherein the inner electrode layer includes the metal powder and the sintering inhibitor and the sintering inhibitor has an average particle size of 1 μm or less and a melting point of 1200° C. or more.

The magnetic layer is prepared from a composition prepared by adding the organic binder and the solvent to the Ni—Zn—Cu ferrite, in detail, the ferrite paste is prepared by adding a solvent such as ethanol and an organic binder such as PVA to a calcinated and ground ferrite fine powder made of NiO, CuO, ZnO, and Fe2O3 forming the Ni—Zn—Cu ferrite as a main material. Next, a magnetic green sheet is obtained by coating the ferrite paste on a PET film, and the like, in a surface shape by a doctor blade method.

Next, the inner electrode layer is formed on the magnetic green sheet and is formed by printing one or more ceramic sintering inhibitor selected from a group consisting of silver (Ag), $ZrO_2$, $MnO_2$, $TiO_2$, and $Fe_2O_3$ as a metal powder and an inner electrode paste including an organic binder, a solvent, and the like, if necessary, by known methods, such as a printing method, a doctor blade method, and the like. The ceramic sintering inhibitor may preferably have an average particle size of 1 μm or less and a melting point of 1200° C. or more. The thickness of the inner electrode layer may be 20 to 80 μm.

Next, as a process of multilayering and cutting each magnetic layer on which the inner electrodes are formed, the inner electrodes are multilayered and integrated so that a spiral coil is configured by interconnecting the inner electrodes through via holes formed on each magnetic layer. Further, a laminate in which the inner electrode layers are formed is cut at a predetermined dimension to obtain an unfired laminate having a chip shape.

Finally, a laminate having a chip shape is obtained by heating and debinding the multilayered and cut unfired laminate and firing the unfired laminate from which the binder component is removed.

The inner electrode and the ceramic body may be preferably co-fired at the time of the firing process and the firing condition is not particularly limited, and therefore the co-firing may be performed according to the general firing conditions of the multilayered inductor and the firing may be preferably performed under the reduction atmosphere in which oxygen is excluded.

According to the exemplary embodiment of the present invention, the inner electrode has a densified structure in which the pore ratio of the section of the inner electrode layer of the chip component subjected to the firing process is 7% or less, preferably 1 to 5%, which is implemented by allowing materials included as the ceramic sintering inhibitor of the inner electrode layer to delay the sintering of the inner electrode and removing the residual carbon. Therefore, after the chip component according to the exemplary embodiment of the present invention is fired, the densification of the inner electrode layer is increased, and thus the RDC characteristics of the multilayered power inductor may be improved.

In addition, the conductive paste is applied to both ends of the laminate having a chip shape by a dip coating method, and the like, to form the outer electrode layer. As the conductive paste for forming the outer electrode, the same material as the inner electrode layer may be used or the known material may also be used, and therefore the material is not particularly limited.

After the outer electrode layer is fired, a plating layer such as nickel and tin may be formed on the outer electrode layer, and therefore the method is not particularly limited.

Hereinafter, Example of the present invention will be described in detail. The following Examples only illustrate the present invention, and a scope of the present invention is not construed as being limited to these Examples. Further, the following Examples illustrate only an example using specific compounds, but it is apparent to those skilled in the art that the same or similar effect is exhibited even when equivalents thereof are used.

EXAMPLE 1

The ferrite paste was prepared by adding ethanol and PVA to the calcinated and ground ferrite fine powder made of NiO, CuO, ZnO, and Fe2O3 as a main material. Next, the magnetic green sheet was obtained by coating the ferrite paste on the PET film in a surface shape by the doctor blade method.

Further, the conductive paste composition for forming the inner electrode layer was prepared by adding a $ZrO_2$ power (melting point of 2715° C.) having an average particle size of 100 nm and 0.5 parts by weight and an organic binder (EC) and a solvent to silver (Ag) of 100 g.

The inner electrode layer was formed to have a thickness of 40 μm by printing the prepared conductive paste composition on the green sheet by the screen printing method.

Next, the green sheet on which the inner electrode layers are formed was connected and multilayered through the via hole and the laminate was cut in a chip shape having a predetermined size.

The cut laminate was debound at 200° C. and was fired at 900° C. under the air atmosphere.

The multilayered power inductor was prepared by dip coating the paste including silver (Ag) on the outer electrode layer.

COMPARATIVE EXAMPLE 1

The multilayered power inductor was prepared by the same method as the above Example 1, except that the inner electrode layer is formed by using the conductive paste composition prepared by adding only the organic binder (EC) and the solvent to silver (Ag) that is a metal powder without including the $ZrO_2$ powder that is the ceramic sintering inhibitor.

EXPERIMENTAL EXAMPLE 1

Figure 2:
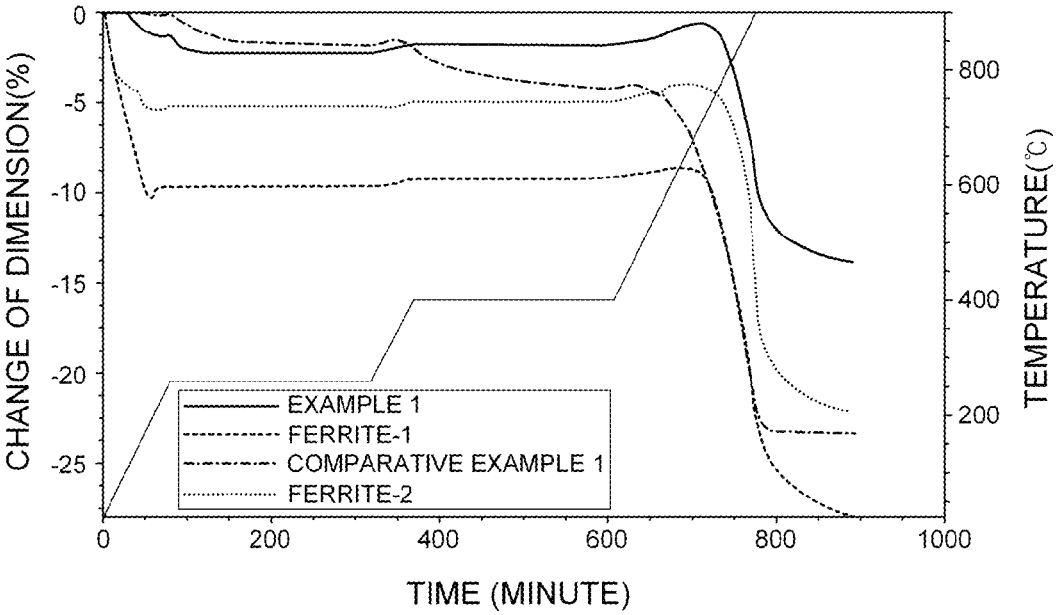
FIG. 2 is a diagram illustrating the multilayered power inductors prepared according to Example 1 and Comparative Example 1 and a TMA evaluation data of a ferrite material.

The thermal behavior of the multilayered chip component prepared according to the above Example 1 and Comparative Example 1 was evaluated based on TMA and the evaluated result was shown in FIG. 2. Two kinds of Ni—Zn—Cu ferrite used in Example 1 were used so as to compare with the magnetic layer body during the co-firing process.

Next, as in the result of FIG. 2, in case of the power inductor of the above Comparative Example 1 that does not include the ceramic sintering inhibitor, it could be appreciated that the firing was first performed from about 400° C. and thus the sintering behaviors of the ferrite magnetic layer materials (ferrite-1 and ferrite-2) are mismatched with each other.

However, in case of the power inductor in which the ceramic sintering inhibitor is included in the inner electrode layer as in Example 1 of the present invention, unlike the above Comparative Example 1, it could be appreciated that the sintering behavior substantially similar to the ferrite magnetic layer material without the change of dimension at about 400° C. is shown. The reason is that the sintering behavior of the inner electrode layer is delayed by hindering the grain growth of the metal powder (Ag powder) during the co-firing sintering process of the ceramic sintering inhibitor included in the inner electrode layer.

Therefore, in case of the multilayered power inductor according to the present invention, the delamination defect such as the crack of the magnetic layer due to the mismatching of the sintering behavior between the inner electrode layer and the magnetic layer according to the related art can be solved.

EXPERIMENTAL EXAMPLE 2

The pore ratio of the inner electrode layer of the multilayered power inductor prepared according to the above Example 1 and Comparative Example 1 was calculated based on the following Equation 1 and the result thereof was shown in the following Table 1.

$$\text{Pore ratio}(\%)=(\text{area occupied by pore/total area of inner electrode layer})\times 100 \quad \text{(Equation 1)}$$

TABLE 1

| | Example 1 | Comparative Example 1 |
|---|---|---|
| Pore ratio (%) | 2.6 | 9.2 |

As in the results of the above Table 1, it could be appreciated that the pore ratio of the inner electrode layer of the multilayered power inductor prepared according to the present invention was calculated as 2.6%, which shows the more improved effect than Comparative Example 1 that does not include the ceramic sintering inhibitor.

From the results, as in the present invention, it could be confirmed that the pore ratio of the inner electrode layer is improved by including the ceramic sintering inhibitor meeting the specific particle size and the melting point in the inner electrode layer.

EXPERIMENTAL EXAMPLE 3

Figure 3:
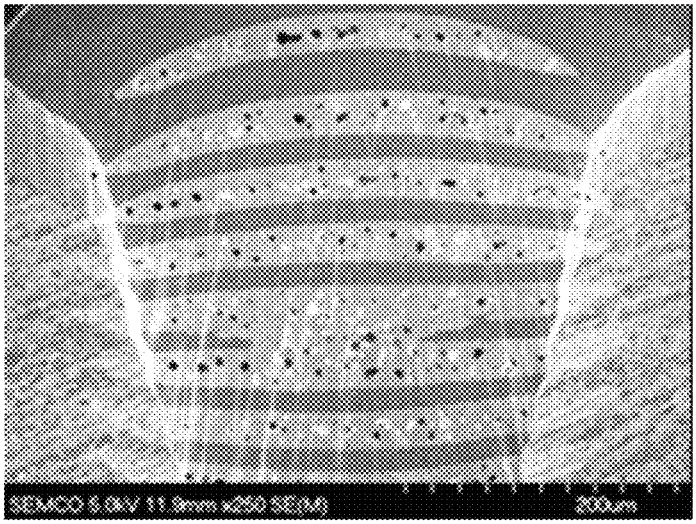
FIGS. 3 and 4 are photographs obtained by taking a structure of an inner electrode layer of the multilayered power inductor prepared according to Example 1 by a scanning electron microscope.
Figure 4:
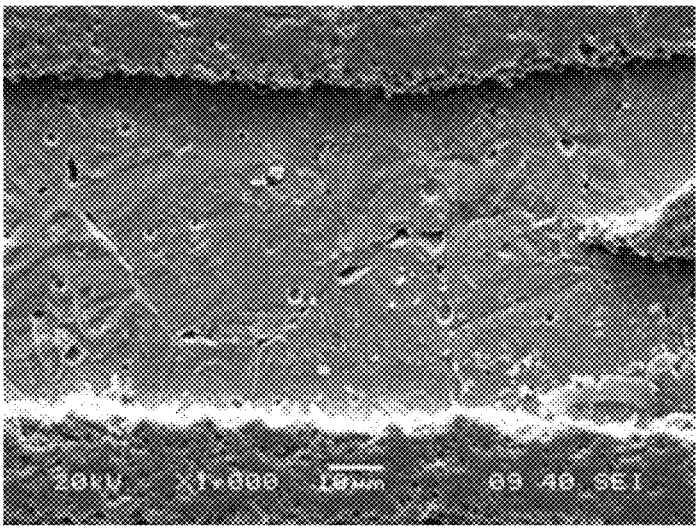

The structure of the inner electrode layer of the multilayered power inductor prepared according to the above Example 1 was measured by the scanning electron microscope and the measured results were shown in FIGS. 3 and 4.

Further, as illustrated in FIG. 3, it could be confirmed that the inner electrode layer of the multilayered power inductor according to the present invention delays the sintering behavior, and thus the surface is not completely densified and the residual carbon is sufficiently removed, thereby reducing the pores of the inner electrode and increasing the densification of the inner electrode after being fired.

Next, as illustrated in FIG. 4, it could be confirmed that the mismatching of the sintering behavior between the inner electrode layer and the magnetic layer due to the addition of the ceramic sintering inhibitor is improved and thus the delamination phenomenon of the ceramic layer due to stress is not shown.

According to the exemplary embodiments of the present invention, the number of pores in the inner electrode layer of the multilayered power inductor can be minimized and the residual carbon can be removed by the sintering delay of the inner electrode to increase the densification of the inner electrode layer after being sintered, thereby improving the RDC characteristics of the multilayered power inductor. Further, the specific ceramic sintering inhibitor is used in the inner electrode layer to allow the ceramic sintering inhibitor to hinder the grain growth of silver (Ag) during the co-firing of the inner electrode and the ceramic body to delay the sintering behavior and to improve the mismatching of the sintering behavior between the ceramic body and the inner electrode, thereby improving the delamination problem of the ceramic body due to stress.

Therefore, the multilayered power inductor including the inner electrode layer according to the exemplary embodiments of the present invention can implement the high capacity and the low RDC, thereby providing the small, thin, and multi-functional chip components.

The present invention has been described in connection with what is presently considered to be practical exemplary embodiments. In addition, the above-mentioned description discloses only the exemplary embodiments of the present invention. Therefore, it is to be appreciated that modifications and alterations may be made by those skilled in the art without departing from the scope of the present invention disclosed in the present specification and an equivalent thereof. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A multilayered power inductor, comprising:

a magnetic layer, an inner electrode layer including a metal powder and a sintering inhibitor, and an outer electrode layer, wherein the sintering inhibitor is one or more selected from the group consisting of $ZrO_2$, $MnO_2$, and $TiO_2$, wherein the inner electrode layer includes a number of pores, and wherein a pore ratio at a section of the inner electrode layer is 7% or less.

2. The multilayered power inductor according to claim 1, wherein the sintering inhibitor is included in the inner electrode layer in an amount of 0.01 to 1 parts by weight for every 100 parts by weight of the metal powder.

3. The multilayered power inductor according to claim 2, wherein the metal powder is silver (Ag).

4. The multilayered power inductor according to claim 2, wherein the sintering inhibitor has an average particle size of 1 μm or less and a melting point of 1200° C. or more.

5. The multilayered power inductor according to claim 1, wherein a thickness of the inner electrode layer is 20 to 80 μm.

6. A multilayered power inductor, comprising:

a magnetic layer;

an inner electrode layer including a metal powder and a sintering inhibitor; and an outer electrode layer, wherein the sintering inhibitor is one or more selected from the group consisting of $ZrO_2$, $MnO_2$, and $TiO_2$, wherein the inner electrode layer includes a number of pores, wherein a section of the inner electrode layer has a pore ratio of 7% or less, and wherein the sintering inhibitor of the inner electrode layer has an average particle size of 1 μm or less and a melting point of 1200° C. or more.

7. The multilayered power inductor according to claim 6, wherein the metal powder of the inner electrode layer is silver (Ag).

8. The multilayered power inductor according to claim 6, wherein the inner electrode layer includes the sintering inhibitor of 0.01 to 1 parts by weight for every 100 parts by weight of the metal powder.

9. The multilayered power inductor according to claim 6, wherein a thickness of the inner electrode layer is 20 to 80 μm.

* * * * *